US007310597B2

(12) United States Patent
Chamberlain

(10) Patent No.: US 7,310,597 B2
(45) Date of Patent: Dec. 18, 2007

(54) SYSTEM AND METHOD FOR ENHANCING BIT ERROR TOLERANCE OVER A BANDWIDTH LIMITED CHANNEL

(75) Inventor: Mark W. Chamberlain, Honeoye Falls, NY (US)

(73) Assignee: Harris Corporation, Melbourne, FL (US)

( * ) Notice: Subject to any disclaimer, the term of this patent is extended or adjusted under 35 U.S.C. 154(b) by 222 days.

(21) Appl. No.: 10/355,209

(22) Filed: Jan. 31, 2003

(65) Prior Publication Data

US 2004/0153318 A1 Aug. 5, 2004

(51) Int. Cl.
*G10L 19/12* (2006.01)

(52) U.S. Cl. ..... 704/222

(58) Field of Classification Search ..... 704/222, 704/200, 201, 230, 219
See application file for complete search history.

(56) References Cited

U.S. PATENT DOCUMENTS 4,791,654 A * 12/1988 De Marca et al. ..... 375/241
6,453,287 B1 * 9/2002 Unno et al. ..... 704/219

FOREIGN PATENT DOCUMENTS

EP 0 294 012 B1 6/1997

OTHER PUBLICATIONS

A fast mean-distance-ordered partial codebook search algorithm for image vector quantization, Ra, S.-W.; Kim, J.-K.;Circuits and Systems II: Analog and Digital Signal Processing, IEEE Transactions on vol. 40, Issue 9, Sep. 1993 pp. 576-579.*

Fast weight-ordered search algorithm for image vector quantisation, Ra, S.W.; Kim, J.K.; Electronics Letters ,vol. 27, Issue 22, Oct. 24, 1991 pp. 2081-2083.*

Ra et al, A fast mean-distance-ordered partial codebook search algorithm for image vector quantization, IEEE Transactions on Circuits and Systems II: Analog and Digital Signal Processing, vol. 40, Issue 9, Sep. 1993 pp. 576-579.*

De Marca, J.R.B., et al., "An Algorithm for Assigning Binary Indices to the Codevectors of a Multi-Dimensional Quantizer", IEEE, vol. 1, Jun. 7, 1987, pp. 1128-1132, XP001149047.

Kovesi, B. et al., "A Fast Robust Stochastic Algorithm For Vector Quantizer Design For Nonstationary Channels", IEEE, vol. 1, May 9, 1995, pp. 269-272, XP010625222.

Cheng, N.T., et al., "Robust Zero-Redundancy Vector Quantization For Noisy Channels", IEEE International Conference, Jun. 11, 1989, pp. 1338-1342, XP010081274.

Supplementary European Search Report.

* cited by examiner

*Primary Examiner*—Angela Armstrong
(74) *Attorney, Agent, or Firm*—Duane Morris, LLP

(57) ABSTRACT

A system and method reduces the effects of the bit-error induced distortion of decoded voice transmission by assigning vectors that are close or similar in Euclidean distance to respective indices that are close in Hamming distance. The system calculates a first distortion sum of the distance error induced by single, double or N bit error possibilities, switches vector assignments and calculates a second distortion sum. If the second sum is less than the first sum the vector swap is maintained.

8 Claims, 5 Drawing Sheets

SYSTEM AND METHOD FOR ENHANCING BIT ERROR TOLERANCE OVER A BANDWIDTH LIMITED CHANNEL

BACKGROUND

Modem communication systems employing digital systems for providing voice communications, unlike many analog systems, are required to quantify speech objects for transmission and reception. Techniques of Vector Quantization are commonly used to send voice parameters by sending the index representing a finite number of parameters, which reduces the effective bandwidth required to communicate. The reduction of bandwidth is especially attractive on bandwidth constrained channels. Vector quantization is the process of grouping source outputs together and encoding them as a single block. The block of source values can be viewed as a vector, hence the name vector quantization. The input source vector is then compared to a set of reference vectors called a codebook. The vector that minimizes some suitable distortion measure is selected as the quantized vector. The rate reduction occurs as the result of sending the codebook index instead of the quantized reference vector over the channel. The vector quantization of speech parameters has been a widely studied topic in current research. At low rate of quantization, efficient quantization of the parameters using as few bits as possible is essential. Using suitable codebook structure, both the memory and computational complexity can be reduced. However when bit-errors occur within the transmitted vector, an incorrect decoded vector is received resulting in audible distortion in the re-constructed speech. For example, a channel limited to only 3 kHz currently requires very low bit-rates in order to maintain intelligible speech.

FIG. 1 displays a sentence of speech that has been synthesized using Mixed Excitation Linear Prediction (MELP, MIL-STD-3005) at 2400 bps where the gain parameters of MELP have been quantized over four consecutive frames of speech using Vector Quantization. This technique of vector quantization can be applied to the vocoder (voice coder) model parameters in an attempt to reduce the vocoder's bit-rate required to send the signal over a bandwidth-constrained channel. In this case a VQ codebook of MELP's gain parameters was created using the LBG algorithm (Y. Linde, A. Buzo, and R. M. Gray. An algorithm for vector quantizer design. IEEE Trans. Comm., COM-28:84-95, January 1980) the content of which is hereby incorporated by reference. The parameter values being quantized represent the root mean square (RMS) value of the desired signal over portions of a frame of speech. Two gain values G1 and G2 are computed and range from 10 dB to 77 dB. These gain values are estimated from the input speech signal and quantized. As part of the standard, G2 is quantized to five bits using a 32-level uniform quantizer from 10.0 to 77.0 dB. The quantizer index is the transmitted codeword. G1 is quantized to 3 bits using an adaptive algorithm specified in MIL-STD-3005. Therefore, eight bits are used in the MELP standard to quantize gain values G1 and G2.

FIG. 1 illustrates the effect of quantizing the gain values over four frames using a codebook with 2048 vectors of length eight (four consecutive frames of G1 and G2 values). Four frames of gain codeword (4*8=32) bits have been reduced to an 11-bit codebook index by vector quantization. The resulting VQ gain codebook speech cannot be discerned as being different from the uniform quantizer method that is used in the MELP speech model.

The codebook created with the LBG codebook design algorithm results in an ordering that is dependent on the training data and choices made to seed the initial conditions. The gain codebook order that was trained using the LBG algorithm was further randomized using the random function available in the C programming language. FIG. 2 shows the effect of a 10% Gaussian bit-error rate on the codebook index values sent over the channel. The segment of signal representing silence in FIG. 1 now shows signs of voiced signal in FIG. 2 representing noticeable audible distortion. The signal envelope or shape has also been severely degraded as a result of the channel-errors and the resulting speech is very difficult to understand.

Thus there is a need to improve the bit-error tolerance performance of low-rate vocoders that use Vector Quantization (VQ) in order to reduce the effective bit-rate necessary to send intelligible speech over a bandwidth constrained channel. Likewise, as codebooks increase in size, it becomes a difficult computational task to order the codebooks using current computer techniques, thus there is a need to reduce the computational complexity of ordering codebooks to improve bit-error tolerance performance.

Therefore it is an object of the disclosed subject matter to overcome these and other problems in the art and present a novel system and method for improving the bit-error tolerance of vector quantization codebooks when using a parametric speech model over a bandwidth constrained channel.

It is also an object of the disclosed subject matter to present a novel method to overcome the computational load of a complete solution of locating the optimal codebook ordering that maps vectors with similar Euclidean distance with vector indices with similar Hamming distance. The invention results in a technique that allows ordering of large codebooks such that the distortion of single and many double bit-errors resulting in vectors that have less audible distortion as compared to random ordering.

It is further an object of the disclosed subject matter to present a novel method for improving bit error tolerance of vector quantization codebooks. Embodiments include sorting the codebook vectors based on Euclidian distance from the origin thereby creating an ordered set of codebook vectors and assigning codewords to the codebook vectors in order of their hamming weight and value. A first distortion sum is calculated for all possible single bit errors and a first pair of successive codewords are swapped, and a second distortion sum for all possible single bit errors is calculated. Embodiments of the disclosed subject matter maintain the swapped vectors if the second distortion sum is less than the first distortion sum; thereby creating an improved bit error tolerance codebook.

It is still another object of the disclosed subject matter to present a novel method of transmitting intelligible speech over a bandwidth constrained channel. An embodiment of the method relates quantized vectors of speech to code words, where the quantized vectors approximate in Euclidean distance are assigned to code words approximate in hamming distance; thereby creating an index. Embodiments also encode the speech object by quantizing the speech object and selecting its corresponding codeword from the index and transmitting the codeword over the bandwidth constrained channel for decoding by a receiver using the same index, thereby allowing the transmission of intelligible speech over the bandwidth constrained channel.

Is yet another object of the disclosed subject matter to present a system for vector quantization reordering an LBG codebook to enable communication over bandwidth constrained channels. Embodiments of the system include a processor operably connected to an electronic memory and hard disk drive storage, the hard disk storage containing a computation program; wherein the processor reorders the LBG code book by reassigning quantized vectors close in Euclidian distance to indices close in hamming distance. Embodiments also include an input device operably connected to the hard drive for entering the LBG codebook; and an output operably connected to the processor for storing the reordered codebook.

It is an additional object of the disclosed subject matter to present a novel improvement for a method in a communication system operating over a bandwidth constrained communication channel, of transmitting quantized vectors by transmitting indices corresponding to the quantized vectors. Embodiments of the improvement comprises the step of corresponding quantized vectors close in Euclidean distance to indices close in hamming distance.

These and many other objects and advantages of the present invention will be readily apparent to one skilled in the art to which the invention pertains from a perusal or the claims, the appended drawings, and the following detailed description of the preferred embodiments.

BRIEF DESCRIPTION OF THE DRAWINGS

The subject matter of the disclosure will be described with reference to the following drawings.

DETAILED DESCRIPTION

Embodiments of the disclosed subject matter orders or maps codebook vectors such that they are more immune to channel errors which induce subsequent voice distortion. The decoded vector with channel errors is correlated with the transmitted vector when using the ordered gain codebook. The embodiments of the disclosed subject matter assign (correlate or match) vectors close (or approximate) in Euclidian distance to codewords (indices) close (or approximate) in hamming distance. The hamming distance between two words is the number of corresponding bits which differ between two words (codewords). This distance is independent of the order in which the corresponding bit occur. For example the codewords 0001, 0100 and 1000 are all the same hamming distance from 0000. This reassignment effectively reorders a codebook containing vectors and indices into a new codebook that has its vectors and indices ordered to increase the bit error tolerance of voice signals transmitted using the codebook.

Figure 1:
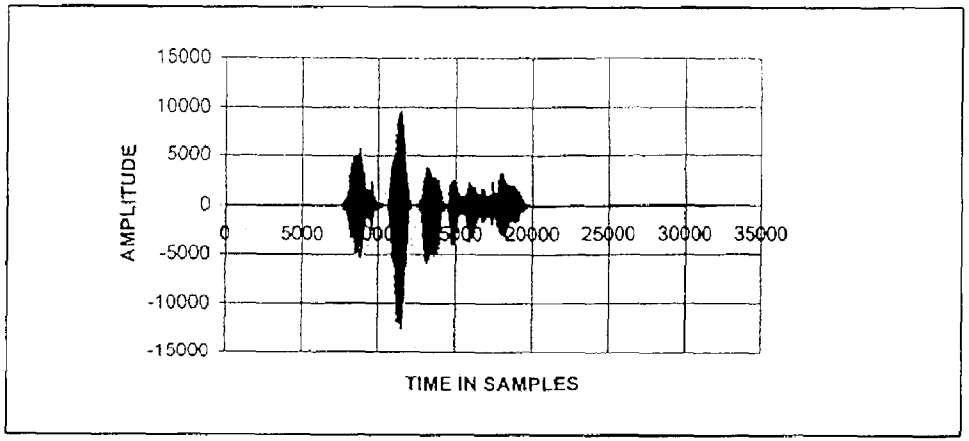
FIG. 1 illustrates synthesized speech ("Tom's birthday is in June")
Figure 2:
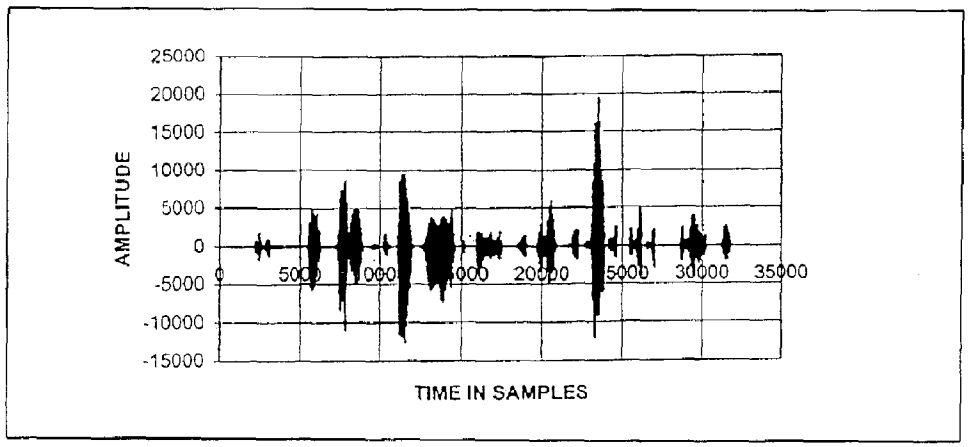
FIG. 2 illustrates synthesized speech as in FIG. 1 with a channel bit error rate of the VQ gain index data of 10%.
Figure 3:
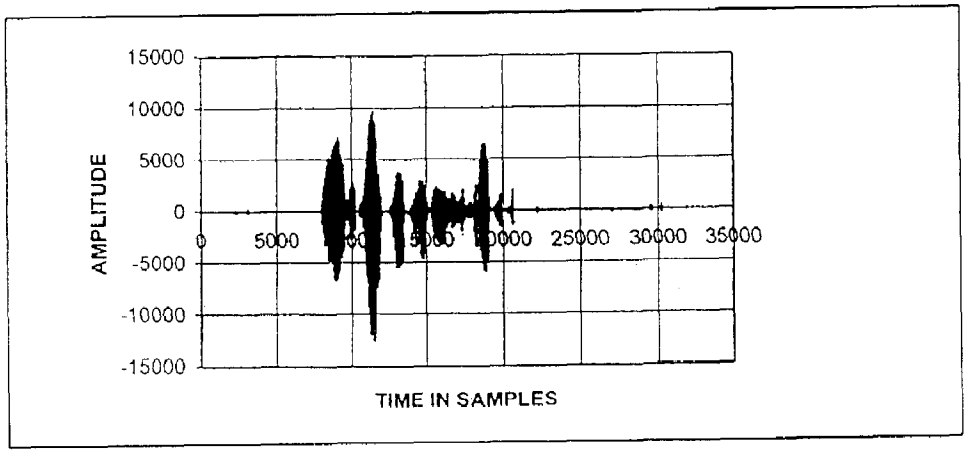
FIG. 3 illustrates synthesized speech as in FIG. 2 with channel bit error of 10% except that the codebook ordering (or mapping) is as defined by the invention.

FIG. 3 shows the effect of codebook ordering on the reconstructed speech under the same 10% bit-error channel as experienced by the reconstructed speech in FIG. 2. The resulting speech envelope shows some signs of distortion of gain as a result of the channel errors. However, the speech envelope has been maintained. In addition, the background noise artifacts seen in FIG. 2 have been greatly reduced in FIG. 3. When compared to the zero bit-error condition, the codebook ordered according to an embodiment of the present invention with 10% bit-errors, at worst sounds like noisy speech. Most importantly however the speech segment can still be comprehended even with the slight increase in background noise level attributable to the bit errors.

Figure 4:
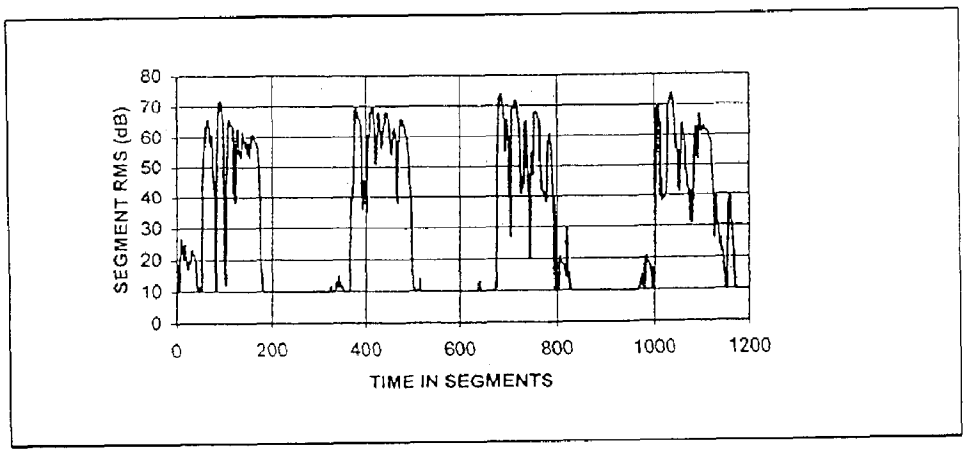
FIG. 4 illustrates the decoded segment energy for the gain parameter codebook for two different speakers (2 sentence male, 2 sentence female) without channel errors.
Figure 5:
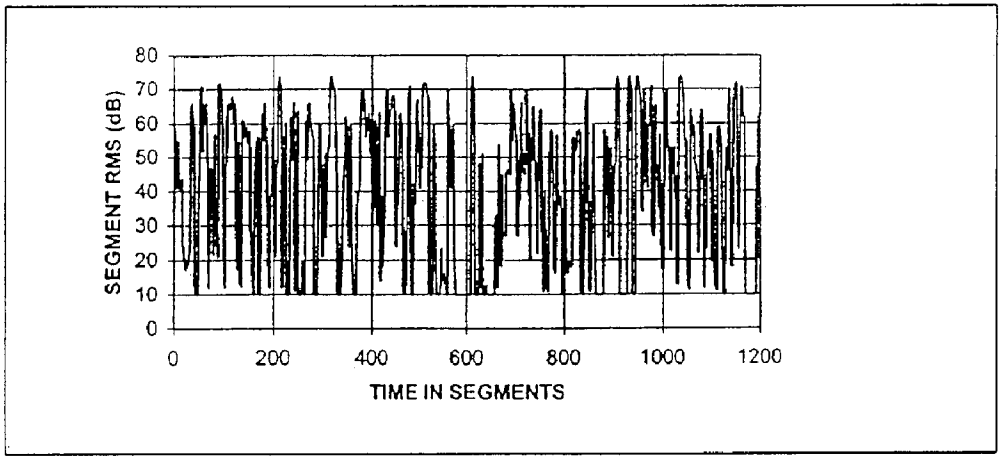
FIG. 5 illustrates the decoded segment energy for the gain parameter codebook using random index assignment as in FIG. 4 with a gain index channel error rate of 10%.

FIG. 4 illustrates the gain values G1 and G2 in time resulting from codebook quantization and without bit-errors. The speech represent two sentences from two speakers, one male and one female. Silence segments represent minimum gain values of 10 dB. The dynamic range of the sentences use the full range allowed by the MELP speech model. The time axis represents an 11.25 ms frame of speech in which two of these intervals represent a single MELP frame. In FIG. 5, the effects of the bit-errors on the random order codebook are evident. The sections of silence have been replaced by large bursts of random noise, and the speech contour or envelope has been lost as a result of the bit-errors, all of which result in unintelligible speech.

Figure 6:
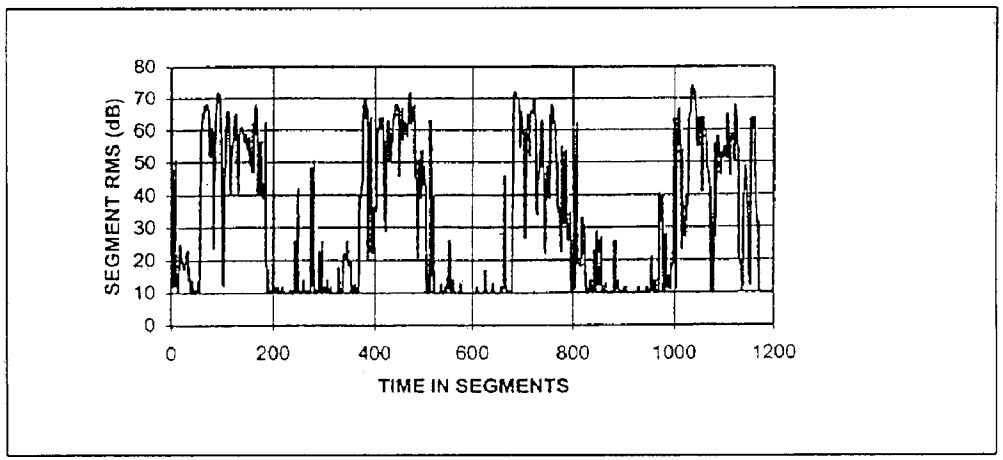
FIG. 6 illustrates the decoded segment energy using the codebook ordering as defined in the invention with a gain index error rate of 10%.

FIG. 6 demonstrates the effects of ordered codebooks according to embodiments of the disclosed subject matter with the presence of bit-errors in the transmitted codebook index or codeword. The implementation of an embodiment of the disclosed subject matter reduces the effects of the background noise when compared to FIG. 5. Comparing FIG. 4 and FIG. 6, a noticeable broadening of the gain contour is evident. The broadening of the energy contour results in speech that is noisy in comparison to an error-free channel. However, most of the significant gain contour has been maintained and thus the speech remains intelligible.

Figure 7:
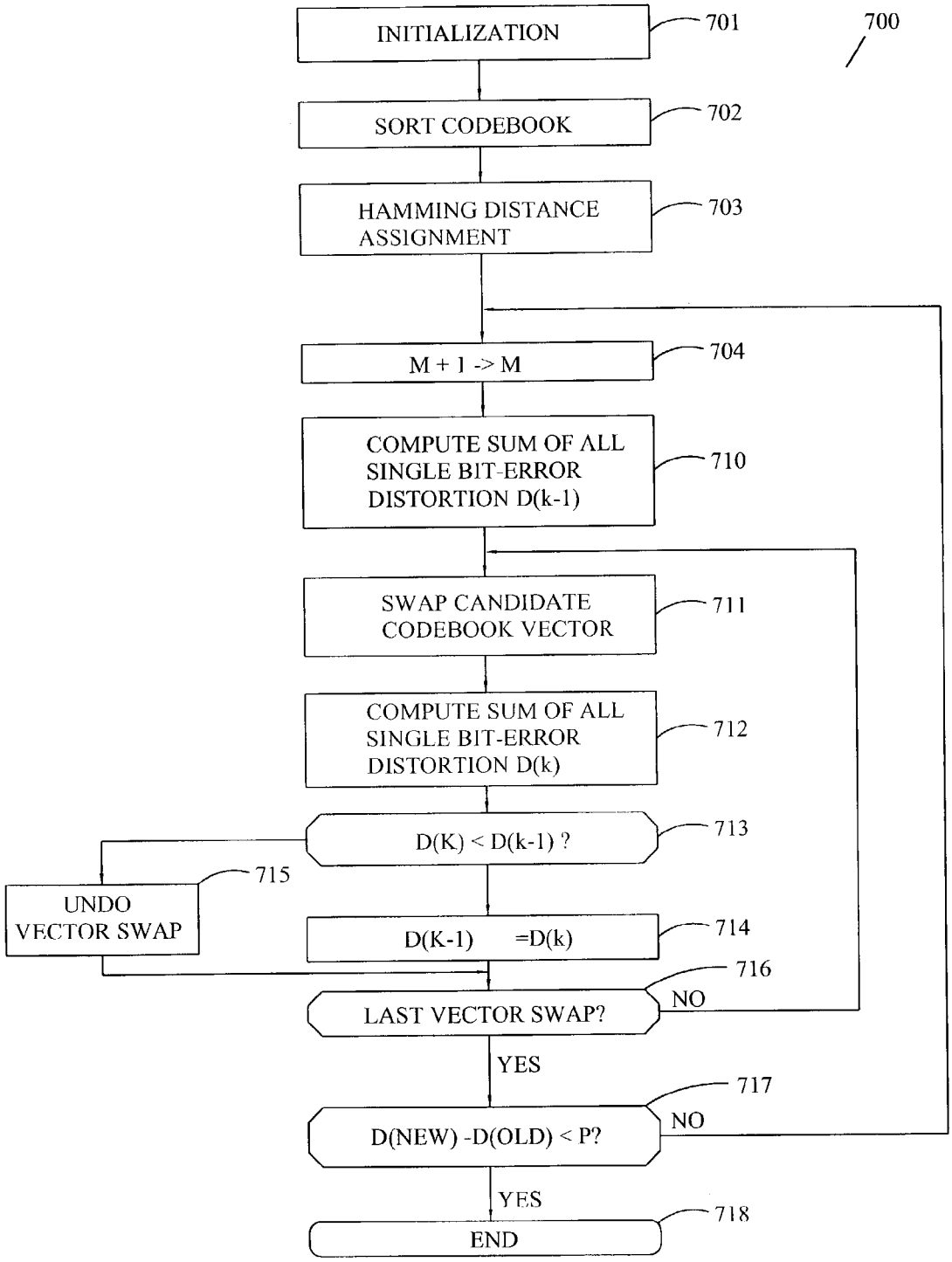
FIG. 7 illustrates the flowchart of the codebook ordering according to the invention.

An embodiment for reordering a codebook according to the disclosed subject matter is shown in FIG. 7. FIG. 7 represents a specific embodiment in which vectors close in Euclidean distance and assigned to indices close in hamming distance. In block 701 initialization for the process takes place. In the initiation block 701, a variety of parameters are computed from the size N and the vector lengths L of the codebook or set of linked vectors and indices that are to be reordered.

The codebook is then sorted in the sort codebook block 702. Block 702 orders the codebook vectors based on their distance from the origin. The codebook vectors are sorted from closest to the origin to farthest. This initial sorting is a precursor that conditions the ordered vectors to reduce the complexity and computational load on the final sorting.

In the embodiment of FIG. 7, codewords are then preliminarily assigned to the sorted vectors in block 703. The codewords are ordered and thus assigned based on (hamming distance)(Euclidean Distance) from the origin (or the all zero vector) which corresponds to hamming weight of the codebook index or codeword. The hamming weight of a codeword is the number of bits which are in the "1" state and is also independent of the position of the bits. For codewords with equal hamming weights, a secondary sorting criteria is used such as decimal value, MSB or other characteristic can be used. Thus the first codeword assigned to the first vector has (a hamming distance of 0) the smallest Euclidean Distance to the all zero vector and a codeword hamming weight of 0, where as the second vector is assigned a codeword with (a hamming distance of 1) the second smallest Euclidean Distance to the origin and a hamming weight of 1 and represents the first or lowest value possible for a codeword with a hamming weight of 1. After the vector presorting and the codeword assignment, a first distortion sum representing the total distance error between the vectors for all possible single bit errors in the respective codewords is calculated as D(k−1) in block 710. This distortion sum can also include the total distance error between the vectors for all possible double bit error is the respective codewords as well.

In block 711 for successive codewords the vectors are swapped, such that the vector assigned to codeword v(n) is reassigned to codeword v(j) and the vector originally assigned to codeword v(j) is likewise reassigned to codeword v(n).

After swapping vectors, a second distortion sum of the total distance error between the vectors for all possible single bit errors, or double bit errors, is again calculated in block 712, in the same manner as the first distortion sum, this sum D(k), however now includes the effects of the swapped vectors. The sums are then compared in block 713, if the second sum is less than the first sum D(k−1), then the second sum D(k) represents a more favorable assignment of codewords and vectors from the perspective of minimizing distortion cause by single bit errors and the swapped vectors are maintained and D(k−1) is replaced with D(k). If the swap is not advantageous then the vectors are swapped back, again if the first distortion sum includes double bit error, the second sum must likewise include theses double bit error possibilities as well.

The process continues with the next successive codewords until the vectors swapped, or subsequently unswapped, are the last two in the codebook, then difference D(new)−D(old) (D(new)−D(old)=D(m)−D(m−1)) is compared in block 717 to a predetermined value P, if the difference is less than P the process is complete however if the difference is not less than P then D(m−1) is equated to D(m) and the process begins again at block 704 where m is incremented by one.

An exemplary algorithm representing an embodiment of the process described in FIG. 7 is shown below for illustrative purposes only and is not intended to limit the scope of the described method. The generic algorithm is set to include only single bit error possibilities.

GENERIC ALGORITHM

Block 701

Initialization: Given the codebook size N and vector length L, the following parameters are computed:

Q=log 2(N)

m=0 n=0

D(old)=MAX FLOAT VALUE

P=0.001 where Q is the length of the codebook index in bits, m, n, and j are counters, and D(k) is the sum of all single bit-error distortion for the current codebook for the kth vector swap Block 702

Presorting the Codebook Y={y(i); i=, . . . , N−1}{y(i); i=0, . . . , N−1}:

$r(0)=\{\text{if min } (dist(0,y(i)))\ n_0=i;\ a11\}\{r(0)$ then is the closest codebook vector to the all zero vector$\}$ $r(1)=\{\text{if min } (dist(0,y(i)))\ n_1=i;\ i<>n_0\}\{r(1)$ is the second closest to the all zero vector, and so on$\}$

↓

$r(N-1)=\{\text{if min } (dist(0,y(i)))n_{N-1}=i;<>n_0,\ n_1,\ .\ .\ .\ ,\ n_{N-2}\}$ The resulting sorted codebook output from block 702 is a group of N vectors, R={r(i); i=0, . . . , N−1}.

Block 703

| Hamming distance assignment: | |
|---|---|
| r(0)~v(0) | 0 value weight 0 |
| r(1)~v(1) | 1st value weight 1 |
| r(2)~v(2) | 2nd value, weight 1 |
| r(3)~v(4) | 3rd value, weight 1 |
| ↓ | |
| r(11)~v(1024) | 11th value, weight 1 |
| r(12)~v(3) | 1st value, weight 2 |
| r(13)~v(5) | 2nd value, weight 2 |
| ↓ | |
| r(2047)~v(2047) | 1st value, weight 11 |

Block 704

Increment value of m by one:

$m=m+1$

Block 710

Compute Sum of all single bit-error distortion:

| | |
|---|---|
| D(k − 1) = | dist(v(0), v(1)) + dist(v(0), v(2)), . . . dist(v(0), v(1024)) + dist(v(1), v(3)) + dist(v(1), v(5)), . . . dist(v(1), v(1025)) + ↓ dist(v(2047), v(2046)) + dist(v(2047), v(2045)), . . . dist(v(2047), v(1023)). |

Block 711

Swap Candidate codebook vectors:

Swap vector v(n) and v(j)

Block 712

Compute sum of all single bit-error distortion D(K) where v(n) and v(j) are swapped.

Block 713, 714 and 715

If D(k)<D(k−1) then D(k−1)=D(k) otherwise undo vector swap

Block 716

If (j==CBSIZE) then (n=n+1, j=j+1)

if(n<(CBSIZE−1) and (j<CBSIZE) then goto block 711)

where CBSIZE represents the codebook size

Block 717

If D(New)−D(old)<P then {D(old)=D(new) and goto block 704}

Block 718

Process complete.

Figure 8:
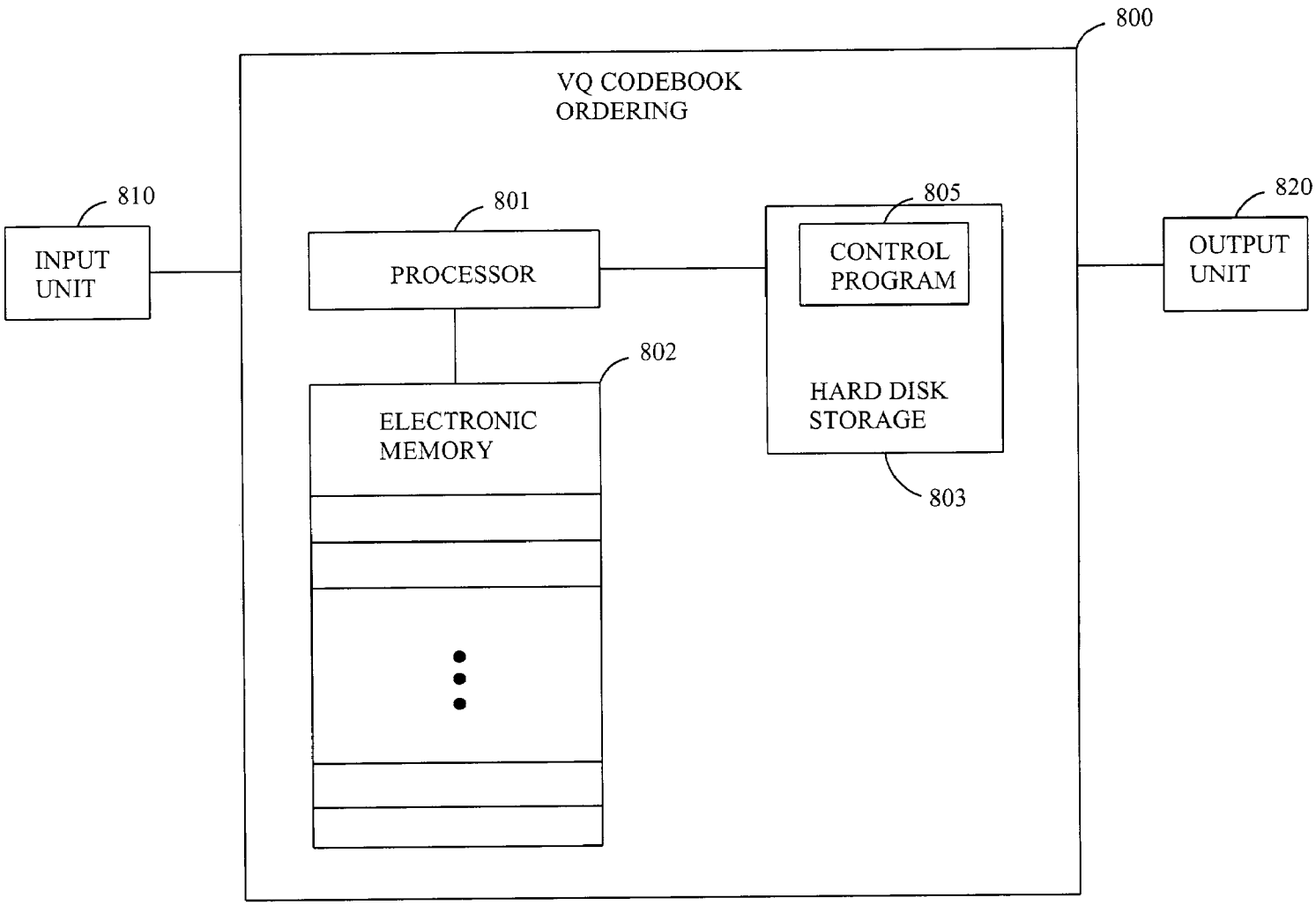
FIG. 8 illustrates a schematic block diagram of a VQ codebook Ordering system according to the invention.

An embodiment of the disclosed subject matter in which the previously described process can be implemented is illustrated in FIG. 8 as system 800. The system 800 includes a processor 801 connected to electronic memory 802 and hard disk drive storage 803 on which may be stored a control program 805 to carry out computational aspects of the process previously described. The system 800 is connected to an input unit 810 such as a keyboard (or floppy disk) in which a codebook can be entered into hard disk storage 803 for access by the processor 801. The output unit 820 may include a floppy disk drive in which the resulting codebook can be removed from the system for use elsewhere. For each input codebook, the system output results in a new codebook with the same vector values that have been ordered differently with respect to their assigned codewords of indices. The assignment decision is made based the vector locations that result in a minimizing effect of Euclidian distance between the actual transmitted vector and the one received and decoded with bit-errors in the transmitted index.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal thereof.

I claim:

1. A method for improving bit error tolerance of a signal to be transmitted, wherein the signal represents an analog signal, comprising the steps of:

(a) obtaining a set of codebook vectors (b) sorting the codebook vectors based on Euclidian distance from the origin thereby creating an ordered set of codebook vectors;

(c) assigning codewords to the codebook vectors in order of their hamming weight and value, (d) calculating a first distortion sum for all possible single bit errors, (e) swapping the vectors of a first pair of successive codewords, (f) calculating a second distortion sum for all possible single bit errors and, maintaining the swapped vectors if the second distortion sum is less than the first distortion sum; thereby creating a new ordered set of codebook vectors (g) transmitting the signal via the new ordered set of codebook vectors wherein the step of sorting is performed before the step of assigning.

2. The method of claim 1, comprising the steps of:

(h) equating the first distortion sum to the second distortion sum if the second distortion sum is less than the first distortion sum, and, (i) swapping the vectors of a next pair of successive codewords, and repeating steps (f), (h) and (i) for all possible pair of codewords.

3. The method of claim 2, comprising the steps of comparing the difference of a previous distortion sum D(OLD) to a current distortion sum D(New) to a predetermined value and repeating steps (e), (f), (h) and (i) based on the comparison.

4. The method of claim 1, wherein the first sum comprises all possible single bit errors and all possible double bit errors.

5. The method of claim 1, wherein the first sum comprises all possible bit errors from single bit errors to N bit errors, wherein N is an integer.

6. A method of transmitting intelligible speech over a bandwidth constrained channel comprising the steps of:

relating quantized vectors of speech to code words, wherein the quantized vectors approximate in Euclidean distance are assigned to code words proximate in hamming distance; thereby creating an index;

encoding a speech object by quantizing the speech object and selecting its corresponding codeword in the index; and transmitting the codeword over the bandwidth constrained channel for decoding by a receiver using the same index, thereby allowing the transmission of intelligible speech over the bandwidth constrained channel.

7. A system for vector quantization reordering an Linde Buzo Gray (LGB) codebook to enable communication over bandwidth constrained channels, comprising:

a processor operably connected to an electronic memory and hard disk drive storage, the hard disk storage containing a computation program; wherein the processor reorders the LBG code book by reassigning quantized vectors proximate in Euclidian distance to indices proximate in hamming distance;

an input device operably connected to processor for entering the LBG codebook;

an output operably connected to the processor for storing the reordered codebook to enable communication over the bandwidth constrained channels.

8. In a communication system operating over a bandwidth constrained communication channel, a method of transmitting information reflective of quantized vectors by transmitting indices corresponding to the quantized vectors, the improvement comprising the step of associating quantized vectors proximate in Euclidean distance to indices proximate in hamming distance and transmitting the information reflective of the quantized vectors by transmitting the corresponding indices.

* * * * *